US006009886A

United States Patent [19]

Labranche et al.

[11] Patent Number: 6,009,886

[45] Date of Patent: Jan. 4, 2000

[54] DENTIFRICE AND FLOSS DISPENSING TOOTHBRUSH

[76] Inventors: Robert Labranche, 70154 Nancy Rd., Mandeville, La. 70471; Geoffrey Grenert, 205 Helmsdale Dr., Chapel Hill, N.C. 27514

[21] Appl. No.: 09/375,225

[22] Filed: Aug. 16, 1999

[51] Int. Cl.[7] ..... A45D 40/24

[52] U.S. Cl. ..... 132/309; 132/308; 132/311; 401/175; 401/186; 401/283; 222/390

[58] Field of Search ..... 132/308, 309, 132/311; 401/283, 186, 280, 287, 271, 183, 268, 175, 195, 17; 222/390

[56] References Cited

U.S. PATENT DOCUMENTS

| | | | |
|---|---|---|---|
| 1,711,183 | 4/1929 | Smith | 132/308 |
| 4,122,983 | 10/1978 | Jolly | 222/390 |
| 4,201,490 | 5/1980 | D'Angelo | 401/175 |
| 4,269,207 | 5/1981 | Konrad et al. | 132/308 |
| 4,957,125 | 9/1990 | Yaneza | 132/309 |
| 5,026,191 | 6/1991 | Akly | 401/175 |
| 5,033,898 | 7/1991 | Williams | 401/283 |
| 5,842,487 | 12/1998 | Ledet | 132/308 |

*Primary Examiner*—Gene Mancene
*Assistant Examiner*—Philogene Pedro

[57] ABSTRACT

A toothbrush which dispenses dentifrice and dental floss. More specifically, the toothbrush is an assembly including a tubular handle integrally connected to a toothbrush neck and toothbrush head, over which a protective sheath having a floss dispenser is removably attached. A dentifrice dispensing mechanism is provided to drive a supply of dentifrice contained in the tubular handle through a duct and conduit in the toothbrush neck and head. The dispensing mechanism is comprised of a twistable knob, a threaded screw, and a screw driven follower. When the knob is turned the piston moves up to handle to force dentifrice through the brush head and into a outlet passage exiting the toothbrush head between the bristles. A plug of foam-like material is disposed within the conduit of the toothbrush head thereby occluding the outlet passage when the plug is in a decompressed state. When the dentifrice is forced against the material, the material is compressed and thereby clears the outlet passage of the plug allowing the dentifrice to exit. The simplicity of the structures described provide a functional design by which manufacturing can be made extremely cost effective for a single-charge dentifrice dispensing toothbrush.

12 Claims, 3 Drawing Sheets

DENTIFRICE AND FLOSS DISPENSING TOOTHBRUSH

BACKGROUND OF THE INVENTION

1. Field of the Invention

The present invention relates to a dentifrice and floss dispensing toothbrush.

2. Description of Prior Art

The prior art is replete with specialized toothbrushes directed at dispensing paste and other hygiene articles such as dental floss, wherein fine differences are employed to distinguish the inventions from another and to overcome associated problems.

The first problem which the toothbrush inventor must address is how to store and dispense a dentifrice. Most of the dispensing devices employ a screw driven plunger internally disposed in a casing for storing the dentifrice, which casing usually also serves as the handle of the toothbrush. The patents including U.S. Pat. No. 4,957,125 issued Sep. 18, 1990 to Yaneza, U.S. Pat. No. 4,122,983 issued Oct. 31, 1978 to Jolly, U.S. Pat. No. 1,711,183 issued Mar. 18, 1926 to Smith, and U.S. Pat. No. 4,950,095 issued to Picard, each describe toothpaste and dental floss dispensing toothbrushes which use screw driven pistons to force toothpaste from a chamber in the handle out of a port.

In the Yaneza patent, a cap on the handle contains a floss spool, which cap is also used to rotate a screw driven piston to force paste from a chamber in the handle of the toothbrush. However, the neck of the toothbrush must be first separated from the handle in order allow the brushhead to be manually rotated 180 degrees and brought into proximity with the port in the handle, similar to the conventional way of squeezing toothpaste from a tube onto a toothbrush. In contrast, the port in the Jolly invention communicates with a tapering chamber exiting to a specially adapted exterior surface of the neck of the brush, the port being manually controlled by an internal cone shaped member mating with the tapered chamber. In further comparison, the Picard toothbrush is adapted to slide between a first and second position, whereby the bristles are fully retracted inside a compartment in the first position during which time a piston device in the handle may be rotated to force paste onto the bristles through a slot proximate to the bristles. Yet another variation as shown in the Smith patent describes a toothpaste dispensing toothbrush having a self-closing annular rubber valve member in the bristle head through which the paste is forced.

Moreover, in each invention the floss dispensing chambers are attached to the end of the handle opposite the bristle head. Such positioning of the dental floss dispenser is disadvantageous in so far as the handle is manipulated while brushing and could inadvertently interfere with the user's hand, unlike a brush head cover which is removed and does not interfere with handling of the brush.

U.S. Pat. No. 3,078,011, issued Nov. 12, 1959 to Safiancoff describes a dispensing apparatus with a triangular reservoir and a screw driven piston that is driven by a knob that is held in place by the bottom of the container; it is generally exemplary of the use of an irregularly shaped chamber to avoid a need for a track or key along which the piston advances when the screw means are rotated.

Other exemplary inventions have features directed toward making the toothbrush for limited use and economically disposable, or in the diametric alternative, reusable and refillable. For example, U.S. Pat. No. 5,026,191 issued Jun. 25, 1991 to Akly describes a toothpaste dispensing toothbrush with a rotary mechanism which can be removed from the chamber for recharging by means of two flanged tabs, which allow a twist knob actuator held on the bottom of the handle by these tabs to be snapped off. The same patent further describes a means which prevents rotation of the knob in a reverse direction such that when the tubular handle is empty of toothpaste, the toothbrush must be disposed.

Other patents address individualized problems associated with and unique to the dispensing brushes. For example, to address traveler's concerns, U.S. Pat. No. 4,886,389 issued Dec. 12, 1989 to Vidovic describes multiple embodiments of a very compact toothbrush for travel and convenient storage in a purse, reminiscent in appearance of a lipstick tube, pocket knife or fountain pen. To address the problem of how to best distribute a dentifrice on the brushhead, United Kingdom Pat. Specification No. 400,831 dated Nov. 2, 1933 describes rubber cones positioned between the bristles as fountains for dispensing the paste towards the surface of the brushhead. In U.S. Pat. No. 5,033,898 issued to Williams, a liquid-type, not paste-type, dentifrice is used to coat each bristle, thus necessitating a sponge-like material for restricting the flow of dentifrice, the material externally covering the dispensing holes in the brushhead. To accommodate refills, United Kingdom Pat. Specification No. 2,070,922 published Sep. 16, 1981 describes a paste dispensing toothbrush having an interchangeable reservoir handle with a bayonet mount at the neck of the toothbrush; moreover, to prevent dehydration of the paste, a split brushhead for reciprocally bringing the paste outlets in and out of registry is shown. Finally, French publication No. 2,659,941 published Sep. 27, 1991 describes a toothbrush head having a rigid shutter disposed within the neck passage and occluding the outlets, which shutter is spring biased by a spring set between the shutter and the wall of the head so that upon forcing the paste forward by a screw means the shutter is forced open.

Although numerous toothbrushes have successfully addressed the problems associated with dispensing paste directly from the body of the brush to the brushhead, none have been able to provide a structure to make the manufacturing highly feasible and minimize its costs. Most notably, regarding the problem of preventing dehydration of the paste, none of the prior art discloses a resilient memoried material forming a plug in the neck passage leading to the outlets of a brushhead so that when the material is put under pressure from the toothpaste, it compresses, and which then springs back to cover the outlets when pressure is released. None of the above inventions and patents, taken either singularly or in combination, is seen to describe the instant invention as claimed.

SUMMARY OF THE INVENTION

The present invention relates to a toothbrush which dispenses dentifrice and dental floss. More specifically, the toothbrush is comprised of a tubular handle integrally connected to a toothbrush neck and toothbrush head, over which a protective sheath having a floss dispenser is removably attached. A dentifrice dispensing mechanism is provided to drive a supply of dentifrice contained in the tubular handle through a duct and conduit in the toothbrush neck and head. The dispensing mechanism is comprised of a twistable knob, a threaded screw, and a screw driven follower. When the knob is turned the piston moves up the handle to force dentifrice through the brush head and into an outlet passage exiting the toothbrush head between the bristles. A plug of foam-like material is disposed within the conduit of the toothbrush head thereby occluding the outlet passage when the plug is in a decompressed state. When the dentifrice is forced against the material, the material is compressed and thereby clears the outlet passage of the plug allowing the dentifrice to exit. The simplicity of the structures described provide a functional design by which manufacturing can be made extremely cost effective for a single-charge dentifrice dispensing toothbrush.

Accordingly, it is a principal object of the invention to provide a dentifrice and floss dispensing toothbrush assembly having a toothbrush separable from a protective sheath.

It is another object of the invention to provide a toothbrush having a single-charge of dentifrice and in which the floss dispenser is contained on the sheath to avoid interference by a strand of floss with the handling of the toothbrush.

It is a further object of the invention to provide a simple and cost effective structure provided to economically manufacture a toothbrush which can be disposed when the dentifrice containing chamber is empty.

Still another object of the invention is to provide a means of preventing the dentifrice from dehydrating at an outlet passage in the brush head using a compressible material to occlude the outlet passage.

It is an object of the invention to provide improved elements and arrangements thereof in a dentifrice and floss dispensing toothbrush for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
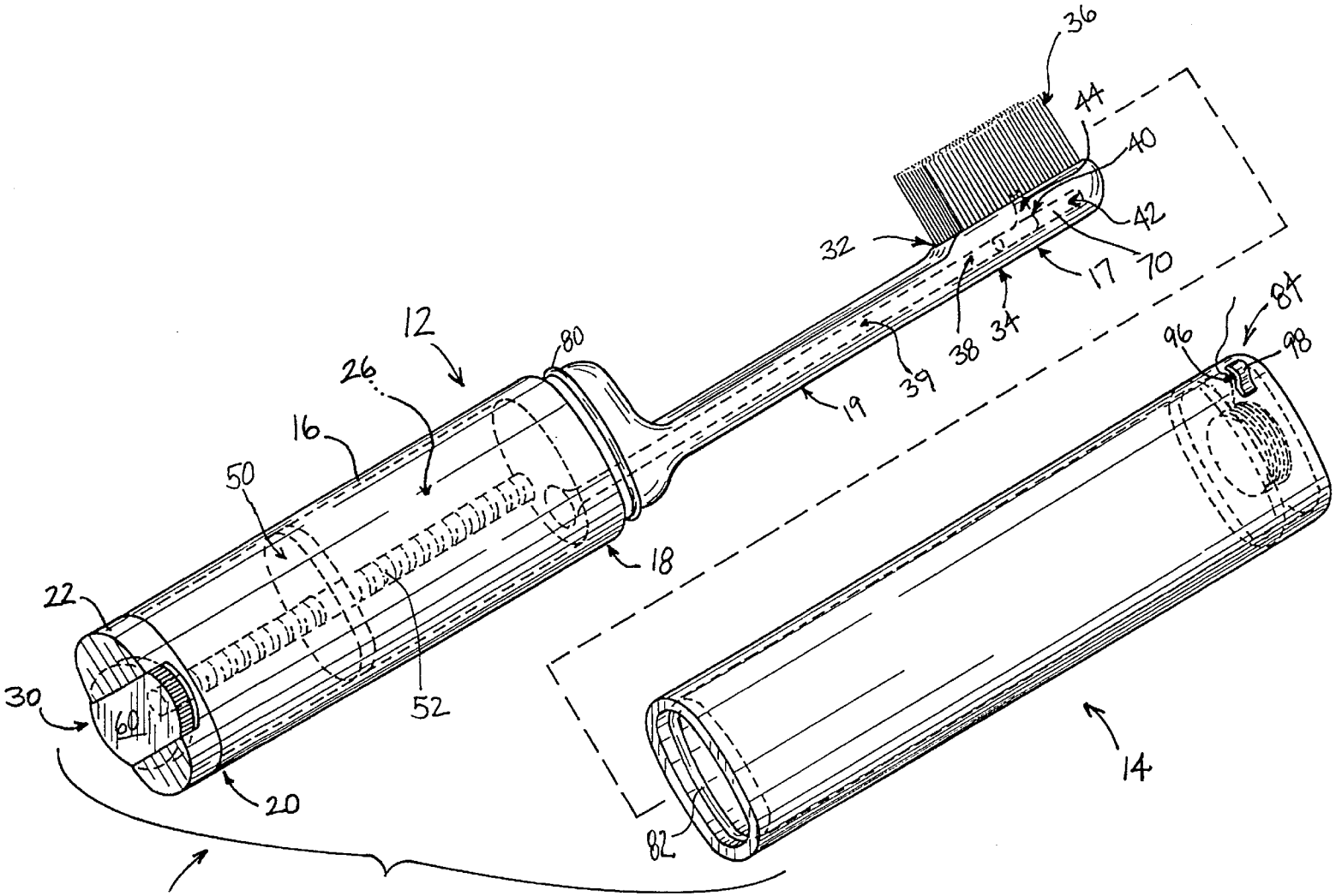
FIG. 1 is a partially exploded, perspective view of a dentifrice and floss dispensing toothbrush with its protective cap fully removed according to the present invention.

The present invention relates to a dentifrice and floss dispensing toothbrush. As can be seen by referring to FIG. 1, the preferred embodiment of the toothbrush assembly 10 includes two major components: the dentifrice dispensing toothbrush 12 and the floss dispensing sheath 14 (herein "toothbrush 12" and "sheath 14"). The toothbrush 12 is an integral unit comprising a tubular handle 16, a toothbrush head 17, and a toothbrush neck 19.

The toothbrush head 17 has the appearance of a typically constructed toothbrush head, having a first surface 32 from which tufted bristles 36 depend, and an opposing surface 34. These surfaces define a longitudinal axis of the head 17; the longitudinal axis may be imagined to pass parallel and centrally between the first surface 32 and the opposing surface 34. The toothbrush neck 19 is integrally attached with the toothbrush head 17 and the tubular handle 18 along this same longitudinal axis to define the elongated toothbrush 12.

Figure 2A:
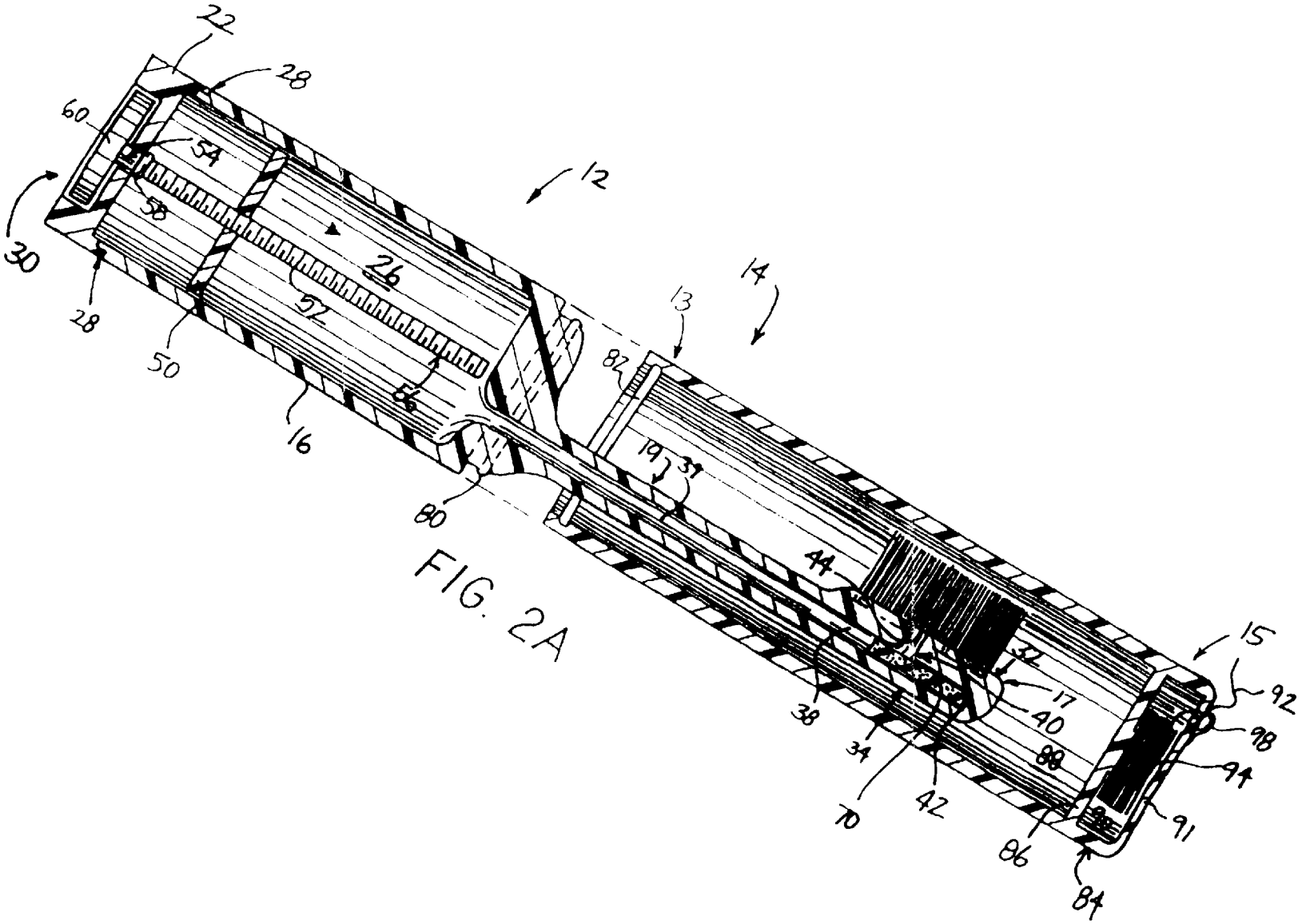
FIG. 2A is a sectional view, partially exploded, of the dentifrice and floss dispensing toothbrush with its protective cap partially removed.

As may be better appreciated from the sectional view of FIG. 2A, along the central longitudinal axis, the toothbrush neck 19 defines an enclosed duct 39 connecting in a continuous and unbroken manner the chamber 26 of the tubular handle 16 with a tubular conduit 38 of the toothbrush head 17. The tubular conduit 38 ends in a bifurcated passage 40. The bifurcated passage 40 is defined by 1) a pocket 42 having no outlet and substantially aligned with the longitudinal axis and 2) an outlet passage 44 exiting the first surface 32.

Focusing now on the tubular handle 16, it defines a chamber 26 for housing a dentifrice, such as toothpaste, tooth gel, or other similar liqui-plastic substances. The tubular handle 16 has a neck end 18 and an opposite open end 20 for introduction of a dentifrice. In FIG. 1, a cap 22 seals the open end 20, thereby completing the tubular handle 16 and retaining the housed dentifrice in the chamber 26 for use. As can be better seen in FIG. 2A, the cap 22 seats on the open end 18 by means of a rabbet joint 28, which may be permanently sealed by adhesive, welding or other suitable fastening means known in the art.

It should be here noted that to take advantage of existing methods of injection molding and known methods of introduction of a semi-fluid medium into a chamber, an alternative embodiment not shown in the Figures may be envisioned in which the cap 22 is integrally molded as part of the tubular handle 16 so as to form a seamless handle. A line of separation elsewhere is however therefore necessary; such a line circumferentially dividing the handle at a point proximate to neck end 18 may be provided using a rabbet joint in a manner similar to that shown at 28 in FIG. 2. The separation may also then be resealed accordingly. Furthermore, to build in obsolescence into the toothbrush, the handle may be filled with a single-charge of dentifrice calculated to run out when the bristles are worn and recommended to be replaced.

A simple screw-type compressing means 30 for forcing dentifrice housed in the chamber 26 is provided. As can be best appreciated from FIG. 3, the chamber 26 has a non-circular cross section which, as will become understood later, minimizes the number and complexity of parts which must be used to manufacture the present invention and eliminates the need for a key or track system, thereby reducing the cost of preparing mold when using known injection molding processes of manufacture. In the preferred embodiment referring to FIG. 1, FIG. 2, and FIG. 3, an oval handle 16 is shown in which a follower 50 dimensioned and configured to closely fit the chamber 26 resides. The follower 50 acts as a piston to compress and push the dentifrice ahead of it through the chamber 26 and into the duct 19 and conduit 38. The follower 50 is threaded onto a threaded shaft 52 so as to reside within the chamber 26. As can be best appreciated from FIG. 2A, the threaded shaft 52 has a first end portion 54 closely passing through an aperture defined in the cap 22. A second end portion 56 is disposed within the chamber and extends substantially the entire length of the chamber 26 so as to allow the follower 50 to compress substantially all of the dentifrice from the chamber 26.

The first end portion 54 is provided with a means for rotatably mounting the threaded shaft to the cap 22; any means known in the prior art may be used. In the preferred embodiments a simple enlargement of the shaft at ring 58 prevents the shaft 52 from passing through the aperture in cap 22. A knob 60 is attached to the first end portion 54 for manually rotating the shaft 52; the knob 60 may be partially enclosed by cap 22 as a guard to prevent undesired or unintentional rotation.

In operation, the knob 60 may be rotated to force the follower 50 towards the neck 19 thereby controlling the amount of dentifrice dispensed. As the shaft 52 rotates, a follower shaped in a circular cross section would spin within the chamber on the shaft if concentrically threaded onto the shaft, because no resistive force from the wall of the handle counters the spinning action, thus necessitating a key or track. However, in an eccentrically mounted shaft or using otherwise irregularly shaped follower, a resistive force from the wall of the handle 16 prevents the follower from spinning and thus forces the follower along the length of the shaft 52, whereby the dentifrice is advanced towards the outlet passage 44.

Figure 2B:
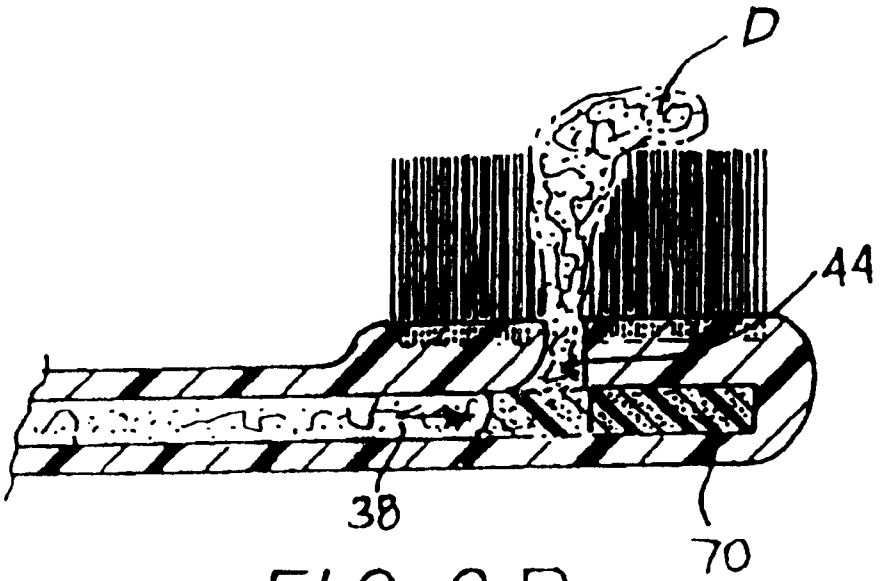
FIG. 2B is an enlarged, sectional view of the head of the toothbrush in FIG. 2A, showing the relative positions of the sealing member in an open and closed state during dentifrice extrusion.
Figure 3:
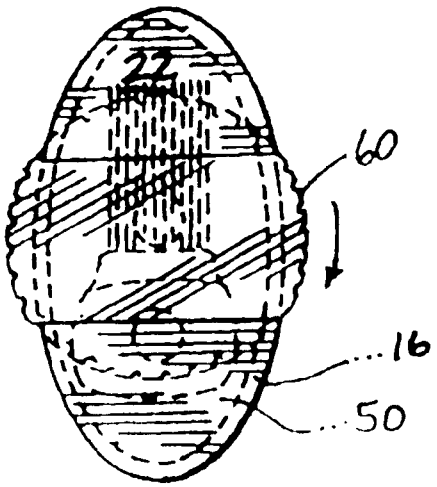
FIG. 3 is a bottom, end view of the toothbrush.

Turning now to FIG. 2B, the means to prevent undesired leakage and dehydration of the dentifrice is described. A plug 70 is shown dimensioned and configured in the cross sectional area to closely fit both the cross sectional areas of the tubular conduit 38 and the pocket 42. The plug 70 is further dimensioned and configured in length to be disposed in part within the pocket 42 and in part disposed within the tubular conduit 39 so as to occlude the outlet passage 44. In the preferred embodiment the pocket 42 and tubular conduit 38 are identical in cross section, so that, during the manufacturing process, the plug 70 may be simply inserted in a one step operation into the neck 19 down the duct 39 into the pocket 42 to rest against the blind wall of the toothbrush head 17 and completely fill the pocket 42.

The plug 70 is made of a material having a resilient memory allowing the material to be compressed. When the material is in a decompressed state, as shown in FIG. 2A, the outlet passage 44 is occluded, thereby preventing dehydration and passage of the dentifrice. However, to allow passage of the dentifrice through the outlet passage, the compressing means 30 are operated to force the dentifrice against the plug 70. The resistance of the material is then overcome by the compressive forces and collapses into a compressed state, as shown in FIG. 2B, allowing the dentifrice D to escape through outlet passage 44. The portion of the plug 70 shown in phantom lines in FIG. 2B represents the decompressed state.

The material for the plug 70 may be chosen from any group of materials having a compressible quality, such as those having a closed cellular pocket structure of many foams. Exemplary materials which are suitable for use are chosen from the group consisting of foamed urethanes or foamed rubbers.

The rest of the assembly 10 of the dentifrice and floss dispensing toothbrush includes an elongated sheath 14 for removably covering the toothbrush head 17 and the toothbrush neck 19. The sheath has a first end 13 and a second end 15, the first end 13 having means for securely and removably engaging the toothbrush neck 19. As shown in FIG. 2A, the means may be a simple ridge 80 provided on the neck 19 and detent 82 provided on the inside of the sheath 14 which removably snap together.

The second end 15 is provided with a floss dispenser 84. To maintain simplicity in manufacture, the sheath 14 may be provided with a septum 86 transversely positioned in the sheath 14 proximate to the second end 15. The septum 86 is a common wall defining a first compartment 88 for receiving the toothbrush head and toothbrush neck and a second compartment 90 for receiving and dispensing floss 92. The septum 86 may be provided with a fixed spindle 94 depending perpendicularly therefrom into the second compartment 90 for receiving a coil of floss 92. The spindle 94 is provided with a spool of floss wound thereon before sealing the compartment with an end wall 91.

To dispense the floss 92, sheath 14 associated with the second compartment 90 defines a pinhole 96 for passage of a thread of floss 92. A floss cutoff means 98, which may be a simple metal blade, is attached proximate to the pinhole 96.

It is to be understood that the present invention is not limited to the embodiment described above, but encompasses any and all embodiments within the scope of the following claims.

I claim:

1. A dentifrice and floss dispensing toothbrush comprising:

a tubular handle having a neck end and an opposite open end for introduction of a dentifrice, the tubular handle defining a chamber for housing the dentifrice;

a toothbrush head having a first surface, an opposing surface and a longitudinal axis passing parallel between the first surface and the opposing surface, the toothbrush head defining a tubular conduit along the longitudinal axis ending in a bifurcated passage defined by a pocket having no outlet and substantially aligned with the longitudinal axis and an outlet passage exiting the first surface, the toothbrush head further having tufted bristles depending from the first surface;

a toothbrush neck being integrally attached with the toothbrush head and the tubular handle, the toothbrush neck defining a duct connecting the chamber of the tubular handle with the tubular conduit of the toothbrush head;

a compressing means for forcing dentifrice housed in the chamber through the conduit and the outlet passage, the compressing means including a cap sealing the open end of the tubular handle; and, a plug made of a material having a resilient memory allowing the material to be compressed, the plug being dimensioned and configured in cross sectional area to closely fit both the cross sectional areas of the tubular conduit and the pocket and further being dimensioned and configured in length to be disposed in part within the pocket and in part disposed within the tubular conduit so as to occlude the outlet passage when the material is in a decompressed state and so as to allow passage of the dentifrice into said outlet passage when the material is in a compressed state.

2. The dentifrice and floss dispensing toothbrush as defined in claim 1 further including an elongated sheath for removably covering the toothbrush head and the toothbrush neck, having a first end and a second end, the first end having means for securely and removably engaging the toothbrush neck and the second end provided with a floss dispenser.

3. The dentifrice and floss dispensing toothbrush as defined in claim 1 wherein the sheath has a septum transversely positioned in the sheath proximate to the second end thereby defining a first compartment for receiving the toothbrush head and toothbrush neck and a second compartment for receiving and dispensing floss, the second compartment thereby defining a floss dispenser terminating the sheath at the second end.

4. The dentifrice and floss dispensing toothbrush as defined in claim 3 wherein the second compartment is provided with a fixed spindle for receiving a coil of floss.

5. The dentifrice and floss dispensing toothbrush as defined in claim 3 wherein the spindle is provided with a spool of floss wound thereon.

6. The dentifrice and floss dispensing toothbrush as defined in claim 3, wherein the second compartment defines a pinhole for passage of thread of floss and provided with a floss cutoff means attached proximate to the pinhole.

7. The dentifrice and floss dispensing toothbrush as defined in claim 1 wherein the cap defines an aperture and the compressing means further includes an elongated threaded shaft, having a first end portion closely passing through the aperture of the cap and a second end portion disposed within the chamber;

means for rotatably mounting the threaded shaft to the cap;

a follower having a cross sectional shape closely fitting the chamber and threaded on the threaded shaft so as to reside within the chamber;

a knob attached to the first end portion for manually rotating the shaft;

whereby the knob may be rotated to force the follower towards the neck thereby controlling the amount of dentifrice forced through the tubular conduit and outlet passage.

8. The dentifrice and floss dispensing toothbrush as defined in claim 2 wherein the chamber has a non-circular cross section and the follower closely fits the chamber.

9. The dentifrice and floss dispensing toothbrush as defined in claim 1 wherein the material is chosen from the group of materials having a compressible, cellular pocket structure.

10. The dentifrice and floss dispensing toothbrush as defined in claim 1 wherein the material is chosen from the group consisting of foamed urethane or foamed rubber.

11. The dentifrice and floss dispensing toothbrush as defined in claim 1 wherein the cap is integrally molded with the handle.

12. The dentifrice and floss dispensing toothbrush as defined in claim 1 wherein the tubular handle contains a dentifrice.

* * * * *